US006205684B1

(12) United States Patent
Snyder

(10) Patent No.: US 6,205,684 B1
(45) Date of Patent: Mar. 27, 2001

(54) STRIKE PAD ASSEMBLY

(75) Inventor: David Charles Snyder, Phoenixville, PA (US)

(73) Assignee: Zephyr Athletic Footwear, Inc., Phoenixville, PA (US)

( * ) Notice: Subject to any disclaimer, the term of this patent is extended or adjusted under 35 U.S.C. 154(b) by 0 days.

(21) Appl. No.: 09/439,796

(22) Filed: Nov. 12, 1999

Related U.S. Application Data

(60) Provisional application No. 60/108,307, filed on Nov. 13, 1998.

(51) Int. Cl.[7] ..... A43B 21/26

(52) U.S. Cl. ..... 36/35 R; 36/141; 36/28; 36/44

(58) Field of Search ..... 36/35 R, 35 B, 36/36 A, 37, 27, 28, 29, 71, 141, 7.8, 43, 44

(56) References Cited

U.S. PATENT DOCUMENTS 3,589,037 * 6/1971 Gallagher ..... 36/44
4,815,221 * 3/1989 Diaz ..... 36/27
4,956,927 * 9/1990 Misevich et al. ..... 36/32 R
5,086,574 * 2/1992 Bacchiocchi ..... 36/35 R
5,175,946 * 1/1993 Tsai ..... 36/29
5,493,791 * 2/1996 Kramer ..... 36/28
5,551,173 * 9/1996 Chambers ..... 36/44
5,787,609 * 8/1998 Wu ..... 36/28
5,918,383 * 7/1999 Chee ..... 36/28

* cited by examiner

*Primary Examiner*—M. D. Patterson
*Assistant Examiner*—Jila M. Mohandesi
(74) *Attorney, Agent, or Firm*—Eugene E. Renz, Jr., PC

(57) ABSTRACT

A strike pad for an athletic shoe to be located adjacent the heel portion of the shoe, made of a flexible resilient material comprising a disc-like upper portion having a series of semi-spherical nubs on its upper face confronting the heels of the user, a thin, circular base portion of a larger diameter than the upper disc portion and a generally circular bottom disc secured to the base of the strike pad by a suitable adhesive or the like.

5 Claims, 2 Drawing Sheets

STRIKE PAD ASSEMBLY

This application claims the benefit of U.S. Provisional Application No. 60/108,307 filed Nov. 13, 1998.

FIELD OF THE INVENTION

The present invention relates to improvements in athletic shoes, and more specifically, to a novel strike pad arrangement.

BRIEF DESCRIPTION OF THE DRAWINGS

These are other optics of the present invention. The various features and the details of the operation and construction thereof are more fully set forth hereinafter. With reference to the accompanying drawings, wherein.

DETAILED DESCRIPTION OF THE PREFERRED EMBODIMENT

Figure 2:
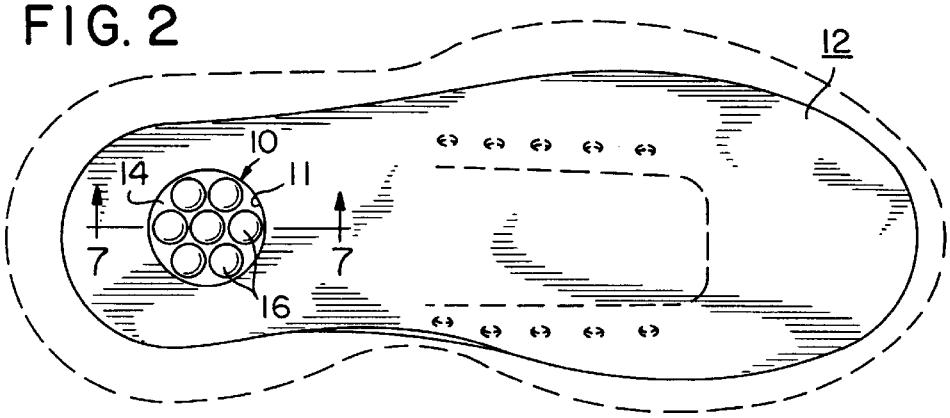
FIG. 2 is a plan view of FIG. 1.
Figure 1:
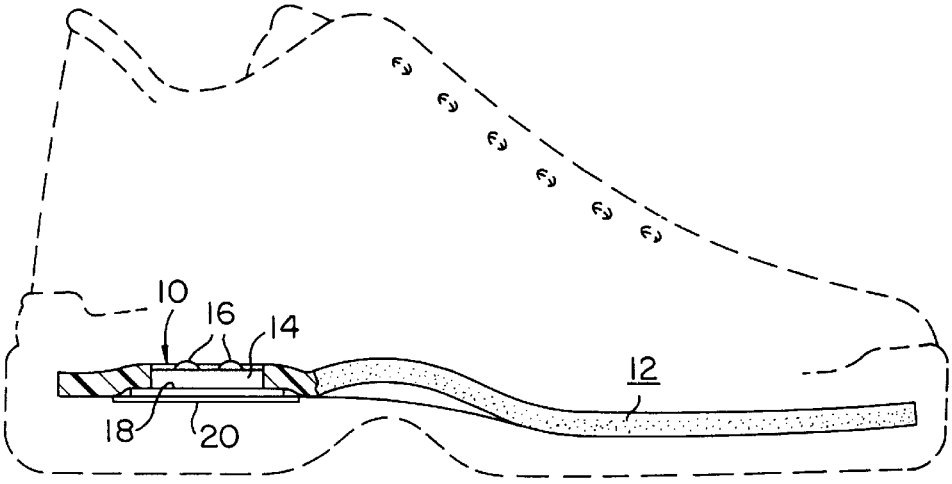
FIG. 1 is a side elevational view of a typical shoe shown in dashed outline retaining a sock liner shown in full line whose heel portion is provided with a heel strike pad the subject of this invention.
Figure 3:
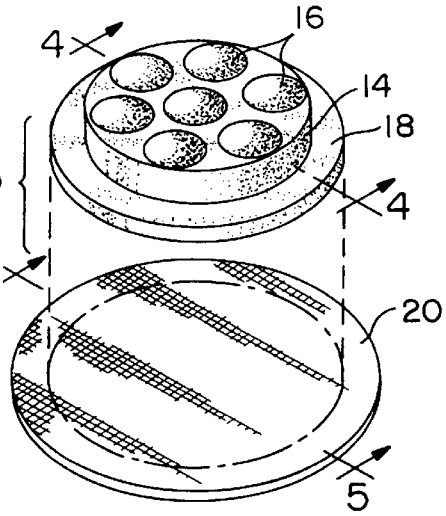
FIG. 3 is an enlarged exploded isometric view showing the elements of the strike pad prior to assembly.
Figure 4:
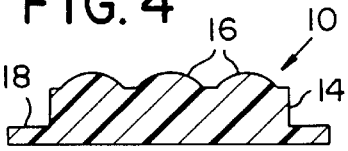
FIG. 4 is an enlarged sectional elevational view taken on the line 4,4 of FIG. 3.
Figure 5:
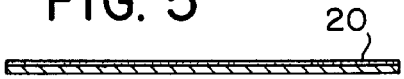
FIG. 5 is an enlarged sectional elevational view taken on the line 5,5 of FIG. 3.
Figure 6:
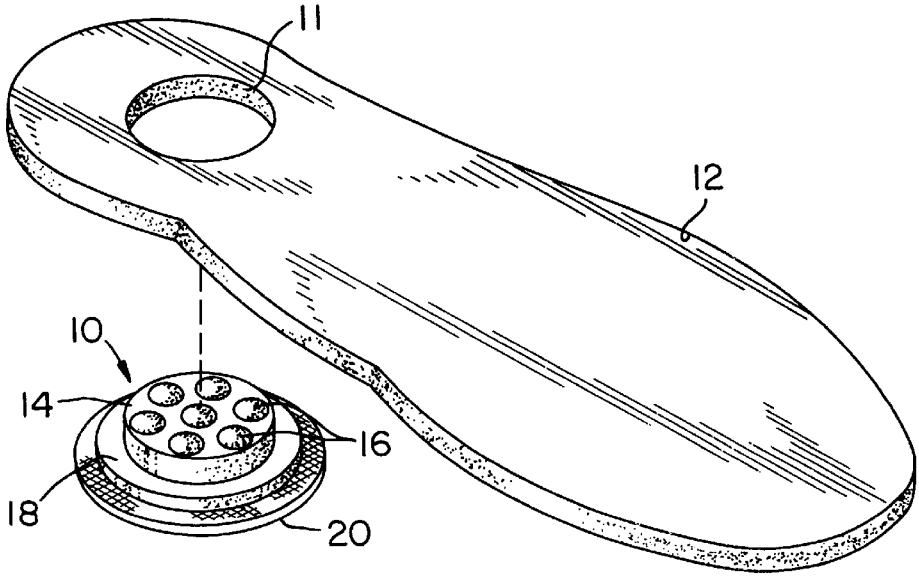
FIG. 6 is an exploded isometric view of the sock liner and heel strike pad prior to assembly.
Figure 7:
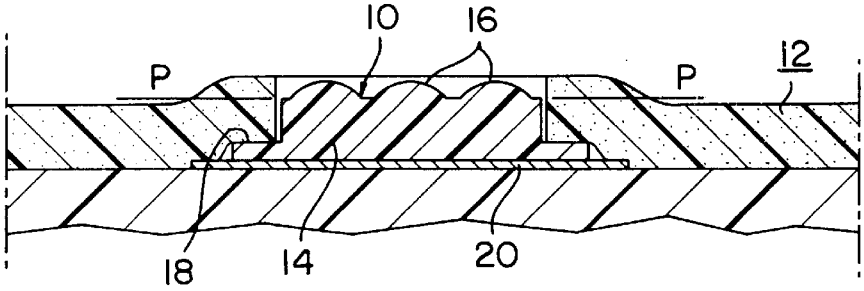
FIG. 7 is an enlarged fragmentary sectional elevational view taken on the line 7,7 of FIG. 2 showing details of the heel strike pad and sock liner as mounted within the shoe.

Referring now the drawings and particularly to FIGS. 1–7, thereof, there is shown a first embodiment of strike pad for an athletic shoe in accordance with the present invention, generally designated by the numeral (10). As illustrated in FIG. 1, the strike pad assembly includes an elongated sock liner (12) of a general configuration to fit in the inner sole portion of the athletic shoe, and which is typically made of a flexible, pliable materials such as foam. The liner (12) has a generally circular opening (11) in the heel portion to accommodate the strike pad (10) of the present invention. The strike pad, as illustrated, is also made of a flexible resilient material, such as a foam or rubber and comprises a generally disk-like upper portion (14) of a size to fit in the circular opening (11) in the liner (12) have a series of semi-spherical projections or nubs (16) on its upper face which confronts the heel of the user. The strike pad (12) has a thin circular-base portion (18) of a larger diameter than the upper disk portion (14) and a generally circular bottom disk (20) secured to the base of the strike pad by a suitable adhesive or the like. The lower disk (20) may be canvas.

In a preferred form of the invention, the nubs (16) project above a plane P-P through the main portion of the disk by 1.5 millimeters and the body of the disk is preferably 4.0 millimeters and the base or lower flange is preferably 1.0 millimeter thick. The lower base flange portion preferably projects beyond the outer periphery of the base by 4.0 millimeters and the diameter of the main portion of the strike pad is preferably 25 millimeters.

Figure 8:
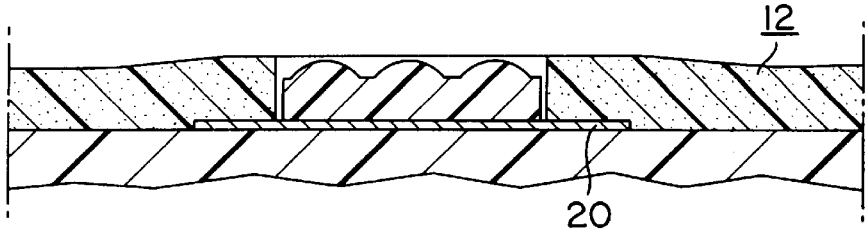
FIG. 8 is a view similar to FIG. 7 but showing a modified strike a pad.

FIG. 8 shows a modified version of the strike pad. In this instance, the base of the strike pad is eliminated and the body portion is simply secured to a lower disk made out of canvas by a suitable adhesive.

Even though particular embodiments of the present invention have been illustrated and described herein, it is not intended to limit the invention and changes and modifications may be made therein within the scope of the following claims.

What is claimed is:

1. A strike pad for an athletic shoe to be located adjacent the heel portion of the shoe, made of a flexible resilient material comprising a disc-like upper portion having a series of semi-spherical nubs on its upper face confronting the heels of the user, a thin, circular base portion of a larger diameter than the upper disc portion and a generally circular bottom disc secured to the base of the strike pad by means for adhesively securing the disc.

2. A strike pad, as claimed in claim 1, wherein the lower disc is made of canvas.

3. A strike pad, as claimed in claim 2, wherein the nubs project above a plane through the main portion of the disc by 1.5 millimeters, and the body of the disc is substantially 4.0 millimeters, and the lower flange is 1.0 millimeter thick.

4. A strike pad as claimed in claim 1, wherein the lower base flange portion projects beyond the outer periphery base by about 4.0 millimeters, and the diameter of the main portion of the strike pad is substantially 25 millimeters.

5. The combination of a liner and strike pad for an insertion in an athletic shoe, wherein the liner has a generally circular opening in the heel portion for mounting the strike pad, and wherein the strike pad comprises a flexible resilient material comprising a disc-like upper portion, having a series of semi-spherical nubs on its upper face, confronting the heels of the user, the thin, circular base portion of a larger diameter than the upper disc portion and a generally circular bottom disc, secured to the base of the strike pad by means for adhesively securing the disc.

* * * * *